United States Patent [19]

Elftmann et al.

[11] 3,990,462

[45] Nov. 9, 1976

[54] SUBSTRATE STRIPPING AND CLEANING APPARATUS

[75] Inventors: Joel A. Elftmann, Minneapolis; Robert S. Blackwood, Chanhassen, both of Minn.

[73] Assignee: Fluoroware Systems Corporation, Chaska, Minn.

[22] Filed: May 19, 1975

[21] Appl. No.: 578,735

[52] U.S. Cl. ..... 134/102; 134/104; 134/140; 134/145; 134/177; 134/200

[51] Int. Cl.[2] ..... B08B 3/02

[58] Field of Search ..... 134/44, 55, 102, 104, 134/138–140, 143, 145, 153, 175, 177, 180–181, 199–200

[56] References Cited

UNITED STATES PATENTS

| | | | |
|---|---|---|---|
| 2,003,003 | 5/1935 | Marbury | 134/177 UX |
| 2,208,646 | 7/1940 | Saunders et al. | 134/104 UX |
| 2,562,076 | 7/1951 | Weisselberg | 134/143 X |
| 3,413,827 | 12/1968 | Kochanek | 134/153 X |
| 3,769,992 | 11/1973 | Wallestad | 134/153 X |

FOREIGN PATENTS OR APPLICATIONS

| | | | |
|---|---|---|---|
| 308,941 | 3/1969 | Sweden | 134/104 |
| 201,005 | 2/1967 | U.S.S.R. | 134/145 |

*Primary Examiner*—Robert L. Bleutge
*Attorney, Agent, or Firm*—H. Dale Palmatier

[57] ABSTRACT

A substrate stripping and cleaning apparatus including a closed bowl with an exhaust vent and a liquid drain, a rotating turntable in the bowl carrying baskets of substrates, a spray post with multiple fluid passages, orifices and spray nozzles directing rinsing spray outwardly against the turntable and substrates, rinsing water manifold pipes on the turntable and revolving therewith and having nozzles directing rinsing water to all portions of the inner surfaces of the bowl, the pipes being supplied with water through passages in the drive shaft for the turntable.

11 Claims, 6 Drawing Figures

FIG. 1
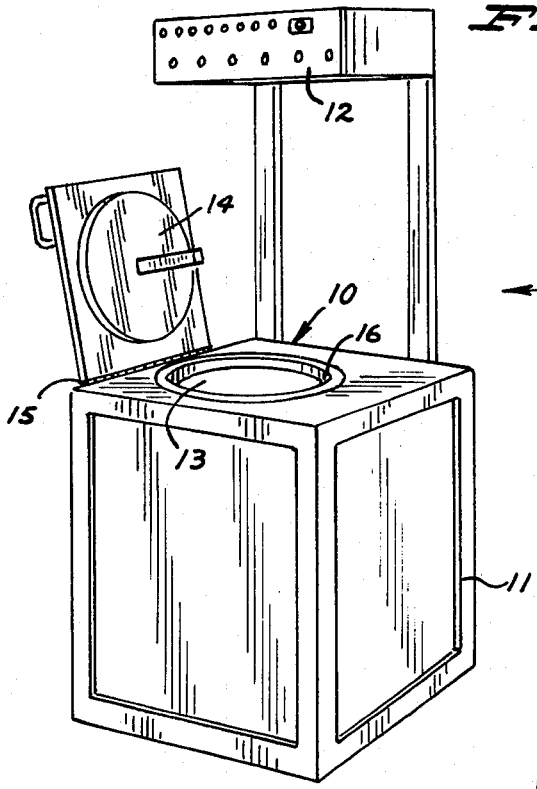
FIG. 4
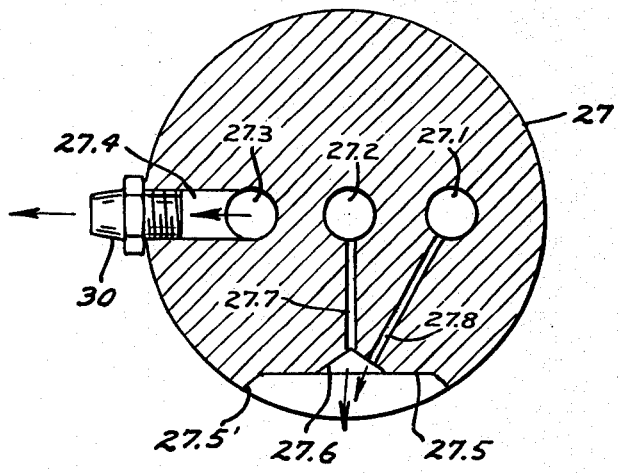
FIG. 3
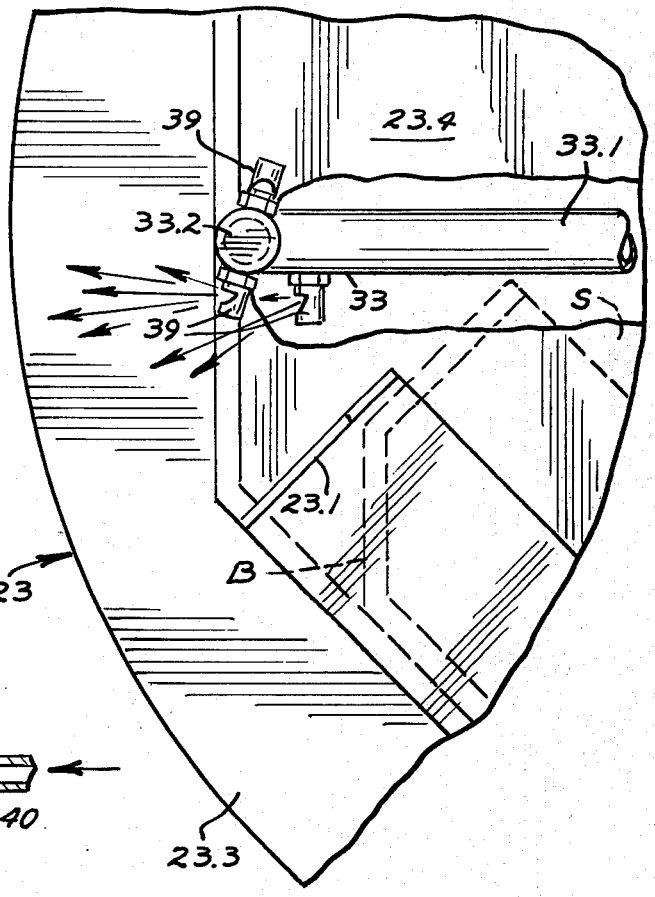
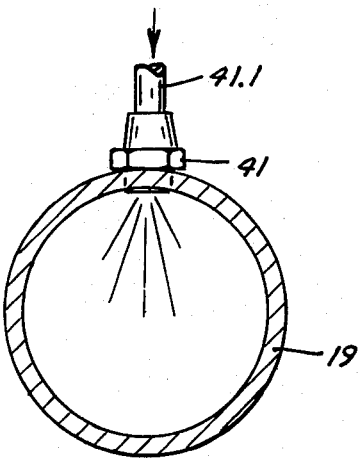
FIG. 5
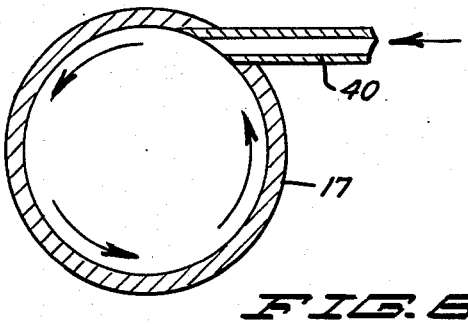
FIG. 6

SUBSTRATE STRIPPING AND CLEANING APPARATUS

BACKGROUND OF THE INVENTION

In manufacturing precision circuits for use in highly sophisticated equipment such as computers and the like, wafers or substrates form the base material for such printed circuitry and may be made of silicone, glass, ceramic materials of various sorts, and other similar materials in very thin wafer-like form. As a part of the processing of such substrates or wafers, it is desirable in various processing steps, to accomplish etching of certain areas of the substrate, to remove photoresist coating which may be applied to the substrate to limit the areas of etching, or to otherwise clean the substrate. In all of these processing steps, the use of an acid is required.

It will be understood, however, that after the completion of such stripping, etching or cleaning processes, the substrates must be extremely clean, without the smallest traces of acid remaining on the substrate.

Where herein, reference is made to etching or stripping processes, it should be considered that reference is also being made to all of the other similar processing of substrates using acid and other similar solutions.

In processing such substrates which may be coated with photoresist, the substrates are supported at their edges in spaced relation from each other in a carrier or basket, and it has been common practice in the past to mount a number of such baskets on a rotary turntable arranged so that the substrates lie substantially perpendicular to the axis of the turntable and the substrates revolve with the carrier and the turntable around the axis. The turntable is confined within a bowl made of stainless steel or other acid resisting material and having a top through which access is obtained into the bowl. The top of the bowl or may not be entirely tiltable upwardly off the bowl to form a closure, but in the event the top of the bowl is stationary, an access port and cover will be provided allowing access into the bowl to place and retrieve the baskets of substrates on the turntable.

In order to apply the acid and rinsing water (oftentimes deionized water) to the substrates, it has been common practice in the past to locate a manifold type post extending downwardly from the top of the bowl approximately at the axis of the turntable with laterally directed nozzles to alternately spray acid and rinsing water and to also carry air or gaseous nitrogen under high pressure and velocity to atomize the acid into a fog type spray for application to the substrate. Application of rinse water from the centrally located manifold post and nozzles has proved to be entirely inadequate because cleaning of the bowl and the turntable in this manner is incomplete and not completely possible. The result has been that the substrates are not entirely free, to the extent necessary, of acid after completion of the cycle of operation in the bowl. It has been found that, if any trace or minute particles of acid remain on any of the surfaces within the bowl, the substrates cannot be expected to be reliably free of acid particles to the degree required by further processing of these substrates.

SUMMARY OF THE INVENTION

According to the present invention, additional and cooperative rinsing together with the rinsing provided from separate rinse nozzles in the spray post is provided for very thoroughly spraying every location within the bowl with a blast of water with sufficient force and velocity as to quickly remove any acid which may cling to any of the interior surfaces. It should be particularly noted that the water spray rinsing devices or nozzles especially spray at each other so that the one that does the rinsing is actually rinsed itself. As a result, an extremely clean bowl results after each cycle of operation with no discernible residual acid remaining anywhere within the bowl.

In order to accomplish this degree of rinsing, the acid delivery passages or flow line is purged with rinsing water, and a separate passage for delivering rinsing water, and especially deionized water, is provided in the spray post with its own series of spray nozzles to spray from the stationary post outwardly against the revolving wafers and the entire turntable and the revolving spray nozzles and delivery conduits or pipes carried on the turntable. Bowl rinsing water is supplied through the rotary drive shaft for the turntable, and into manifold pipes carried directly on the turntable and provided with nozzles for spraying inwardly and outwardly and upwardly and downwardly against all of the peripheral surfaces of the bowl and also spraying the central post area which delivers the primary rinse water for the wafers of substrates.

The liquid drain carrying acid and rinse water from the sump at the bottom of the bowl is substantially continually subjected to a severe cleaning action by directing rinsing water tangentially and circumferentially around the internal periphery of the drain so that no minute particles of acid will remain in the drain without being thoroughly flushed away. The bowl is provided with a gas or air discharge vent to carry away the drying air and the air from the atomizing air blast used with the acid spray. The bowl vent pipe has a rinsing nozzle directing a curtain of water transversely across the vent pipe and collecting all the acid particles that may be carried with the venting air. The spray water forming the curtain across the vent pipe continually flushes the vent pipe and forces all of the acid residue collected into the bowl sump and out through the liquid drain.

BRIEF SUMMARY OF THE DRAWINGS

FIG. 1 is a perspective view of the substrate processing mechanism.

FIG. 3 is an enlarged detail top plan view of a portion of the turntable.

FIG. 4 is an enlarged detail section view taken approximately at 4—4 in FIG. 2.

FIG. 5 is an enlarged detail section view taken approximately at 5—5 in FIG. 2.

FIG. 6 is an enlarged detail section view taken approximately at 6—6 in FIG. 2.

DETAILED DESCRIPTION OF THE INVENTION

Figure 2:
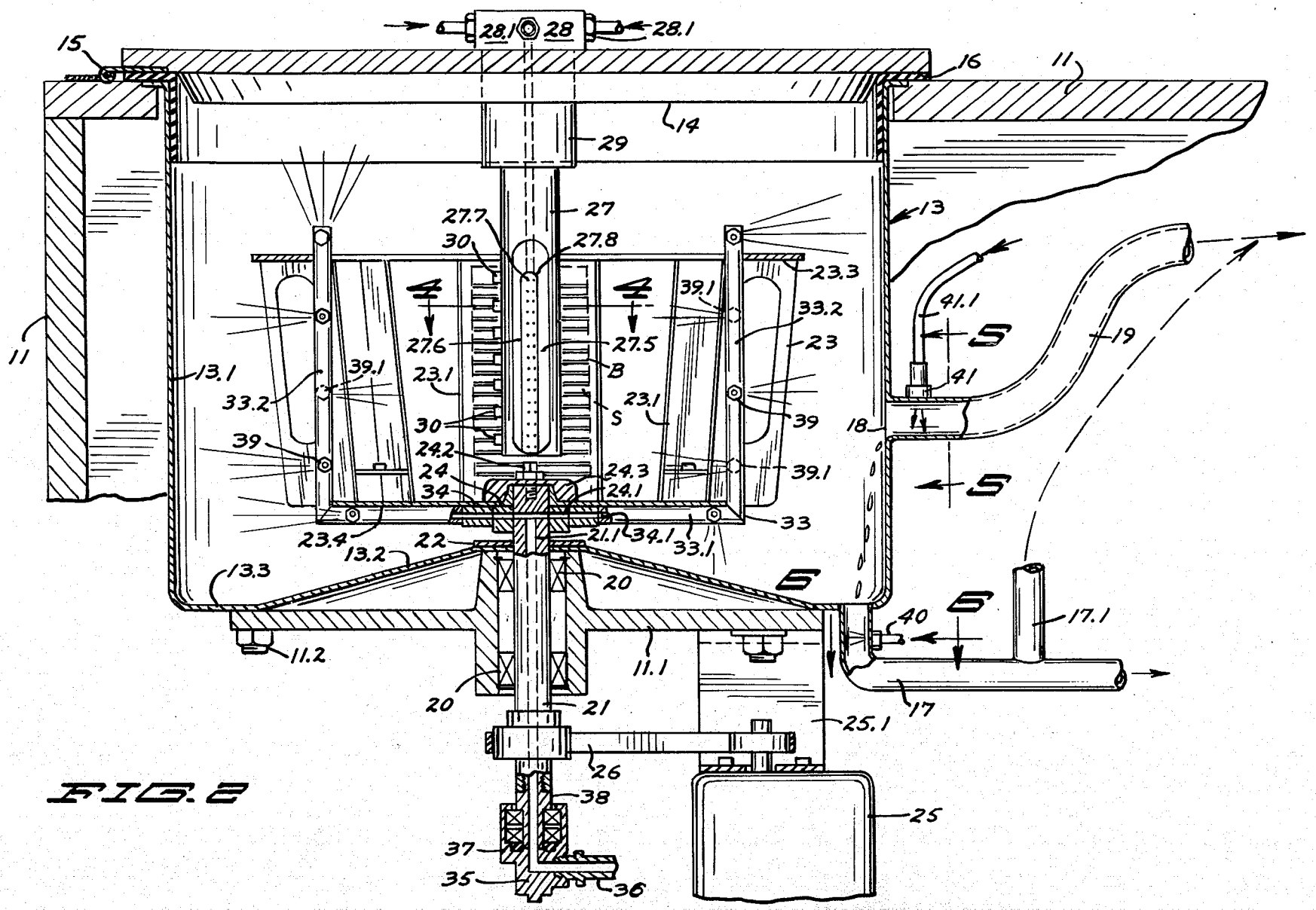
FIG. 2 is a greatly enlarged detail section view taken through the bowl in which the processing occurs.

One form of the invention is shown in the drawings and is described herein. The substrate etching and stripping apparatus is indicated in general by numeral 10 and is mounted in and carried by a housing 11 having a suitable control panel 12 including various circuitry for automatically sequencing various portions of the cycle of operation. The apparatus includes a circular bowl 13 in which the stripping and etching takes place, and the bowl 13 has a suitable top and cover 14. The cover 14 has a mounting hinge 15 connected to the housing and frame 11, and the cover fits tightly with a peripheral gasket 16 at the upper marginal edge of the bowl 13. A suitable latch or clamp is provided for holding the cover 14 in its closed condition.

The bowl 13 is constructed of a suitable material as to be resistive to the various acids such as sulfuric acid and hydrofluoric acid which may be used in the various etching and stripping and cleaning processes. Typically, bowl 13 may be formed of stainless steel.

The bowl 13 has upright and substantially cylindrical sidewalls 13.1, a bottom wall 13.2 which has an overall convex shape when viewed from the interior of the bowl so as to define a sump area 13.3 around the lower periphery. A drainpipe 17 is attached to the bottom of the bowl 13 at the sump to drain away the liquids collected in the sump.

The bowl 13 also has a vent opening 18 located in a position spaced well above the bottom sump area of the bowl and a gas carrying duct 19 connects the vent 18 to a central exhaust system drawing a small vacuum in the interior of the bowl when operating. The vacuum may be relatively small, such as one inch of water.

A frame plate 11.1 which is carried by the frame and housing 11 has the bowl mounted thereon and fastened thereto by fitted studs 11.2. Bearings 20 on the frame plate 11.1 mount a rotary drive shaft 21 which extends upwardly through an opening in the bottom wall 13.2 of the bowl and through a suitable seal or bushing 22 mounted on the bottom wall of the bowl. The shaft 21 carries a turntable or rotor 23 in the bowl 13 for the purpose of carrying the substrates which may be of any of a number of materials such as silicone, glass, ceramic, etc. The substrates are indicted by letter S and are illustrated diagrammatically in dotted lines and are carried on the turntable 23 in suitable baskets on carriers B which hold the substrates by their edges and maintain the substrates in spaced relation with each other so that moisture and air may easily pass between adjacent substrates. Each of the baskets B is confined in a separate compartment 23.1 of the turntable in such a position that the several substrates are substantially lying in planes normal to the rotation axis of the shaft 21 and turntable 23. Therefore, sprays which are directed outwardly from the central area of the turntable 23 will easily pass between the substrates S.

The compartments 23.1 of the turntable 23 are tipped outwardly slightly, and one principal reason of this tipping is to facilitate ready and easy loading of the baskets and substrates onto the turntable. The turntable 23 has a bottom circular panel 23.2 to which the compartments 23.1 are affixed, and an annular or ring shaped plate 23.3 at the top of the compartment. The center or central area of the turntable 23 is entirely open.

The bottom plate 23.2 of the turntable rests upon a supporting hub 24 which is affixed on shaft 21, and the bottom panel 23.2 is held in place by a clamping hub 24.1 which is secured onto the end of the shaft 21 by a cap screw 24.2.

It will be understood that the turntable 23 may have any of a number of mounting compartments 23.1 for the substrate baskets B and that the turntable 23 should be loaded symmetrically when used. In this particular turntable 23 as illustrated, there are six compartments 23.1 for the substrate baskets, but in other turntables there may be four such compartments, or in some instances, eight compartments or more.

The shaft 21 is driven from motor 25 which is suspended from the frame plate 11.1 on a bracket 25.1. The motor drives through a belt and pulley asssembly 26 to the shaft 21 so that the motor may be maintained in offset relation and non-aligned relation with respect to the shaft 21.

A spray post 27 is suspended from the top of the bowl 13, and in this instance is suspended from the swingable cover 14. The spray post 27 protrudes through the cover 14 and connects to a distribution head 28 to which the fluid connections are made. A collar 29 at the interior of cover 14 retains the spray post in position and serves to pull the post 27 tightly against the head 28. Spray post 27, as seen in FIG. 4, has three separate passages 27.1, 27.2 and 27.3 extending longitudinally therethrough. The post 27 forms a manifold for supplying various fluids to the spray nozzles and orifices.

In the form illustrated, the passage 27.1 is principally for delivering etching or stripping acids such as sulfuric acid or other acids previously mentioned. The passage 27.1 is connected to a valve which alternately will direct acid or rinsing water, preferably deionized water, through the passage.

Passage 27.2 is connected through the head 28 to a source of gas, preferably gaseous nitrogen, or in some instances simply air which is delivered under pressure.

The passage 27.3 delivers rinsing water, preferably deionized water, in order to obtain the maximum cleansing.

It will be seen that a series of nozzle heads 30 are supplied by ducts 27.4 which communicate with the rinsing water passage 27.3. The nozzles 30 are of the type to produce a fan-shaped spray pattern, and the nozzles 30 are oriented so that the fan-shaped spray patterns will cumulatively define a substantially solid curtain of spray directed substantially radially outwardly from the spray post 27 toward the substrates S and turntable 23. The individual nozzles 30 may be oriented slightly out of alignment with each other so that the fan-shaped spray patterns have a minimum of interference with each other, but the overall effect of the spray patterns from the series of nozzles 30 which are vertically aligned along the spray post 27 is to produce a solid vertical curtain of spray adjacent the post 27.

The spray post 27 also has an enlarged recess 27.5 adjacent the fluid passages 27.1 and 27.2. The recess 27.5 extends substantially the full length of the spray post within the turntable 23 so as to extend along all of the substrates S in the baskets. The recess 27.5 has a very significant width relative to the overall diameter of the post 27, and has a very significant depth as compared to the radius or thickness of the post. The edges 27.5' of the recess are sharply angular so that the substantially flat face at the bottom of the recess is disposed well behind the extension of the circular periphery of the post, as illustrated in FIG. 4.

At the bottom of the recess 27.5, there is a substantially V-shaped groove 27.6 formed. A plurality of ducts 27.7 communicate between the apex of the V-shaped groove 27.6 and the passage 27.2 for directing jets of air outwardly through the V-shaped groove 27.6.

A plurality of ducts 27.8 interconnect passage 27.1 with one side of the V-shaped groove 27.6, each duct 27.8 being disposed immediately adjacent and to one side of the outlet end of a corresponding duct 27.7. The cooperative action of the air and acid in the groove 27.6 and in the recess 27.5 is the creation of an atomized fog-type spray which is directed substantially radially outwardly from the post 27 to the substrates S for the purpose of wetting all of the substrates as they whirl around in the bowl with the turntable. Because of the protection afforded by the shape of recess 27.5 and by the recess 27.6, relative to the exterior periphery of the post 27, the cone-shaped atomizing fog spray which is solid is allowed to form up and obtain direction before the whirling and turbulent atmosphere in the bowl is encountered at the space between the post 27 and the substrate S.

The head 28 is connected through fittings 28.1 to various connecting lines and hoses which supply acid, air and deionized water under pressure to the post 27. Suitable valving will cause the fluids to stop and start and will change the fluid in passage 27.1 between acid and water.

The internal surface of the bowl 13 and the spray post 27 is rinsed clean during each cycle of operation by rinse water supplied through a pair of rotating manifold pipes 33 which are affixed to the rotating turntable 23. The pipes 33 are arranged on the turntable 23 opposite each other, across a diameter, and the inner ends 33.1 of the pipes extend inwardly directly toward the rotation axis of the turntable 23. The inner ends 33.1 are securely affixed into a ring-shaped rigid mounting 34 which has water carrying ports 34.1 communicating with the interior of the pipes 33. The mounting ring 34 surrounds the mounting hub 24 and is sealed thereto. The mounting hub 24 also has diametrically arranged internal water carrying passages 24.1 for supplying water to the pipes 33.

Rinse water is supplied to the hub 24 from longitudinally extending passages 21.1 formed through the drive shaft 21. Because the motor 25 is offset from the drive shaft and driven through the belt and pulley apparatus 26, a rotating seal is easily fitted to the end of the shaft so as to supply rinsing water into the passage 21.1. A stationary fitting 35 at the end of the shaft 21 is connected to a water supply pipe 36. The stationary fitting 35 is connected through a seal 37 to a revolving fitting 38 threaded into the ends of shaft 21, thus facilitating supplying high pressure water into and through the shaft 21 for the manifold pipes 33.

It will be noted that the outer ends 33.2 of the pipes extend upwardly through the turntable 23 at diametrically opposite locations, and between adjacent basket carrying compartments 23.1. The outer ends 33.2 of the pipes are fitted with a plurality of spray nozzles 39, each of which has a flat fan-shaped spray pattern for directing high intensity rinsing spray. It will be recognized that the various spray nozzles are variously oriented so that all portions of the cylindrical sidewall 13.1, and the bottom wall 13.2 and the top 14 are intensely sprayed and washed free of any acid residue.

It is particularly important that certain of the nozzles 39 are fitted into the horizontal inner portions 33.1 of the manifold pipes for intensely scrubbing all portions of the bottom wall and sump of the bowl.

Certain of the nozzles 39.1 on the manifold pipe 33 direct their fan-shaped sprays inwardly toward and against the spray post 27 so that the acid residue is completely cleared from the spray post 27 from which significant amounts of rinsing water are supplied from the nozzles 30. The relative rotary motion between the manifold pipes 33 and the stationary spray post 27 causes all portions of the spray post 27 to be rinsed by the rinsing sprays from the nozzles 39.1, and simultaneously the water sprays from the nozzles 30 clean and rinse the acid residue from all portions of the turntable 23 as well as from the pipes 33 mounted thereon.

An additional rinse water pipe 40 is connected into the drain 17, immediately adjacent the connection of the drain 17 to the sump of the bowl 13. As illustrated in FIG. 6, the pipe 40 is considerably smaller than the drain 17, and is connected into the drain substantially tangentially of the periphery of the drain so that a high velocity jet of water is directed from the source pipe 40 circumferentially around the inner periphery of the drain 17 to intensely rinse and loosen any acid residue that may tend to collect. Accordingly, even though all of the acid residues that are released from surfaces in the bowl 13 and in the revolving and stationary parts therein are all washed down through the drain 17, there is an absolute minimum likelihood that any of the acid residue will stop or collect on the inner periphery of the drain.

The drain 17 is also provided with an exhaust duct 17.1 through which exhaust air or gases may be drawn into the exhaust system along with gases from the duct 19.

The duct 19 is primarily for exhausting gaseous nitrogen or air used to atomize the acid spray in the bowl 13 and also for producing the final drying of the bowl and of the substrate being processed. The minute acid particles that may be airborne are removed from the exhausting air or gas as soon as the gas passes through the vent opening 18 by an intense transverse curtain of water spray directed across and entirely filling the exhaust duct from a nozzle 41 mounted on the duct 19 immediately adjacent the vent 18. The nozzle is supplied through a pipe 41.1 so as to produce a flat spray in the shape of a transverse curtain across the duct 19 to absorb all of the acid particles that may be borne in the air or gas.

It will be understood that suitable valving is provided to start and stop the supply of water through the pipes 41.1 and 40, and of course the rinse water is stopped and started by suitable valving controlling flow through the pipe fittings 35 and 36 to the manifold pipe 33, and also through the water passage 27.3 in the spray post 27. Suitable valving is also provided for controlling a flow of air through the passage 27.2 of the spray post 27; and additional valving is provided for alternately directing acid and water through the passage 27.1 to be sprayed and atomized into the bowl from the orifice or small duct 28. Suitable valving is also provided so that gaseous nitrogen can be blown through the solution lines and passages 27.1 to completely purge the solution from these passages and prevent any subsequent dripping of solution in the bowl after the cycle has been completed.

In a typical operating cycle of the apparatus, substrates coated with photoresist are placed in the baskets B which are then laid in the compartments 23.1 of the turntable 23. Turntable 23 is formed of an acid-resisting molded plastic material so that its shape or characteristics will not be effected at all by the acid which is sprayed within the bowl 13.

When the turntable 23 has been loaded with a suitable number of baskets B containing the substrates S, the cover 14 is closed and latched so that the interior of the bowl 13 is completely isolated and sealed from the exterior atmosphere. A slight vacuum is drawn at the exhaust duct 19 and vent 18 so that there is a slight vacuum in the chamber within the bowl 13.

Initially, the turntable 23 may be revolved at approximately 50 rpm, and simultaneously sulfuric acid mixed with hydrogen peroxide is supplied through the passage 27.1 and through orifices 27.8 to be spayed from the spray post 27; and simultaneously nitrogen under considerable pressure is supplied through the passage 27.2 and through the orifices or ducts 27.7. The effect of the gas acting on the acid being sprayed is to atomize the acid into a fog with very minute acid particles which are essentially airborne. The sprays from each of the orifices of the spray post are essentially solid cones of fog so that the acid will entirely wet all of the substrates in all of the baskets on the revolving turntable 23. Simultaneously, the rinse water is directed through the pipes 40 and 41.1 to continuously flush and rinse the vent 18 and the drain 17. The flushing of the vent and drain is continued all during the stripping process and thereafter during the bowl flushing process.

The acid spray is continued for approximately sixty seconds in one example to thoroughly wet all of the substrates being processed. Subsequently, the turntable may be stopped for another sixty second period while the substrates are simply allowed to soak with the acid which has been applied; and during this period the vent and drain flush are still operating.

After the substrates have been permitted to soak with the acid previously applied, and with the turntable 23 remaining stationary so that none of the acid is slung off due to centrifugal force, the turntable 123 may again be revolved at a modest speed of 50 rpm for another sixty second period while additional acid is sprayed in with the dense atomized fog of spray from the spray post 27. The turntable may again be stopped and the supply of acid and gas through the post 27 may be terminated so that the substrates may be permitted to simply soak in the acid which has been applied previously. It should be understood that the sequential steps may be varied some, but these described steps are considered to be somewhat typical of various procedures that may be employed.

Subsequently, the turntable 23 may be revolved again to revolve the substrates around the spray post and more acid may be applied from the spray post as previously described.

After the desired amount of stripping or etching has been accomplished, the application of acid into the spray post and bowl may be entirely terminated. During the final stripping stage during which there is a continuance of application of acid, the turntable may be operated at a substantially greater rotary speed, such as 150 rpm, to accomplish some slinging of the photoresist and acid from the faces and edges of the substrates.

After application of the acid through the spray post 27 has been terminated, a preliminary or coarse rinse cycle is commenced. This initial rinsing period will terminate the etching or stripping of the substrates, and will produce initial cleaning of the bowl interior. The turntable will be revolved at a moderate speed of approximately 50 rpm for as much as 10 minutes or more, and during this preliminary rinse, water under pressure is applied through the manifold pipe 33 so that sprays of water are directed from the nozzles 39 and 39.1. Simultaneously, the solution passages 27.1 will be flushed with water being directed therethrough and through the ducts or orifices 27.8. The water reacts with the gas from the passage 27.2 in the same manner that the acid previously did, and a solid spray pattern of atomized water is directed outwardly from the spray post 27 to the substrates S for diluting and then sluicing away all of the acid previously collected thereon. The flat fan sprays from the nozzles 39 and 39.1 are directed with high intensity toward all of the peripheral surfaces of the bowl and the cover and the bottom wall, and simultaneously the spray post 27 is also intensively cleaned with the high intensity spray patterns from nozzles 39.1. During the bowl rinsing stage, the vent and drain flushing may be terminated.

The next stage may involve increasing the speed of the turntable 23 to 250 rpm for a short period, such as thirty seconds, to sling off as much excess water as possible, and simultaneously, the solution passages and lines 27.1 and 27.8 are purged by blowing nitrogen through them.

Finally the finish rinsing is accomplished by directing water under considerable pressure through the passage 27.3 in the spray post, causing the substantially vertical curtain of water spray to be directed outwardly from the spray post to the revolving turntable 23, and simultaneously, the bowl rinse spray from manifold pipe 33 is again produced by applying water through the drive shaft 21 and related fittings. This finish rinse of the bowl interior and of the substrates is accomplished with the turntable 23 revolving at a moderate speed of approximately 50 rpm, and the high intensity spray from the nozzles 30 efficiently rinses the turntable 23, the substrates S, the baskets B for the substrates, and the manifold pipes 33 and their nozzles, and simultaneously the high intensity spray from the nozzles 39.1 and 39 produces intense rinsing of the spray post 27 and its retaining collar 29 as well as the other interior surfaces of the bowl and cover. This intense rinsing from nozzles 30, 39 and 39.1 continues over a substantial period such a ten minutes. Finally the water flow is stopped, and with the turntable operating at a high rate of speed, such as 700 rpm, nitrogen is blown through the passages 27.3 and through the manifold pipes 33 to drive out all of the moisture particles from everywhere in the bowl and all the apparatus therein and cause the moisture particles to find their way to the drain 17 or outwardly through the vent 18 and exhaust 19.

The final drying cycle, particularly directed to the substrates, is carried out with the speeed of the turntable 23 again increased to higher speeds such as 1000 rpm and with the high intensity gas being blown outwardly from passage 27.3 and through the nozzles 30 so as to completely dry the substrates in the bowl.

It will be understood that, because of the combination of the intense rinsing from the spray post with a substantially stationary highly dense curtain of sprayed water, and the revolving spray patterns from the manifold pipes 33 and related nozzles 39 and 39.1, the apparatus doing the rinsing is itself rinsed, as are other surfaces of the bowl so as to remove all traces of any acid residue in the bowl at the completion of the cycle. There is a relative rotation between the nozzles 39.1 and nozzles 30, and in this instance the nozzles 39.1 revolve about the spray post and nozzles 30. In some instances it may be desirable to revolve the central spray post as well, but at a different velocity than the rotary speed of the turntable. Similarly, in some instances, it may be desirable to have the spray post 27 affixedly mounted relative to the bowl 13 on a stationary top wall, rather than tipping the spray post out of the bowl when the top is open. By offsetting the motor 25 from the drive shaft 21, there is no interference between the motor and the liquid passages which supply rinsing water into the bowl rinse manifold pipes 33. However, in some installations it may be desirable under certain circumstances to supply the water to the manifold pipes 33 by stationary or non-rotating conduit extending into the bowl.

What is claimed is:

1. In apparatus for spraying articles such as substrates for cleaning and the like, an upright bowl with a closed top, a turntable within the bowl for revolving about an upright axis, the turntable having mounting means supporting the substrates for revolution therewith, a stationary spray source located centrally of the turntable and including spray nozzles directing water under force outwardly onto the turntable and the substrates revolving with the turntable, and bowl cleaning water spraying means independent of said mounting means and rotating with the turntable and including a plurality of spray nozzles variously oriented to direct water under force in multiple directions toward the stationary spray source and elsewhere in the bowl.

2. The invention set forth in claim 1 and water spray means including manifold pipes at the turntable periphery and extending along the bowl wall and directing rinse water and toward the top, bottom and peripheral interior walls of the bowl.

3. The invention set forth in claim 1 and the spray nozzles of the stationary spray sources directing rinse water in substantially flat fan shaped sprays to define a substantially continuous curtain of rinse water from top to bottom of the turntable, said spray source including an upright nozzle-carrying post with fluid supply passages, and the spray nozzles of the water spray means directing rinse water in substantially flat fan sprays inwardly against the post.

4. The invention set forth in claim 1 and motor driven means connected to and driving the turntable and including a rotary drive shaft extending into the bowl and connected to the turntable in driving relation, the shaft having a water passage extending longitudinally therethrough, and means on the turntable connecting the shaft passage to the water spraying means for delivering water thereto.

5. The invention set forth in claim 1 and including a gas and air discharging vent in the bowl, and rinse means including a water spray nozzle directing a curtain of water transversely across the vent to collect and rinse away airborne minute acid particles.

6. The invention set forth in claim 1 and including a sump and drain in the bottom of the bowl, drain flush means including a water delivery pipe directing clean rinse water into the drain and removing acid that may have collected on the drain interior.

7. The invention set forth in claim 5 and including a sump and drain in the bottom of the bowl, drain flush means including a rinse water delivery pipe connected to the drain and delivering clean rinse water circumferentially around and within the drain to prevent collection and remove acid at the drain interior.

8. The invention set forth in claim 7 and the stationary spray source including a multi-passage manifold having first and second fluid delivery passages and cooperating outlets for air and acid to atomize the acid into a fog spray and a separate clean rinse water passage connected to the spray nozzles of the stationary spray source and directing water outwardly against the substrates and turntable.

9. The invention according to claim 4 wherein said motor driven means including a motor mounted adjacent said bowl, and offset from said rotary drive shaft, drive means connecting and driving the shaft from the motor, and a stationary supply line and fitting connected to the water passage in the drive shaft.

10. In apparatus for spraying articles such as substrates for cleaning and the like, an upright bowl with a closed top, a turntable within the bowl for revolving about an upright axis, the turntable having substrate-engaging mounting means supporting the substrates for revolution therewith, a stationary spray source located centrally of the turntable and including spray nozzles directing water under force outwardly onto the substrates revolving with the turntable, and water spraying means including a plurality of nozzles adjacent said mounting means and rotating with the turntable said spray nozzles being variously oriented to direct water under force in multiple directions in the bowl.

11. In apparatus for spraying substrates which are arranged in spaced and confronting relation to each other in open carriers for cleaning the substrates, an upright bowl with a closed top, a turntable within the bowl for revolving about an upright axis and having compartment means confining the carriers for revolving and substrates in planes lying substantially normal to the axis, a stationary spray source located centrally of the turntable and including a manifold spray post extending along and adjacent the rotation axis and having a plurality of spray nozzles along the length thereof and directing water under force outwardly onto the turntable and the substrates revolving with the turntable, and water spraying means on the turntable and rotating therewith and including manifold pipes extending outwardly to the turntable periphery and extending adjacent the periphery longitudinally of the rotation axis, such manifold pipes having nozzles spaced from the compartment means and being variously oriented to direct water under force in multiple directions adjacent and past the substrates to impinge against the bowl walls and the spray post.

* * * * *

UNITED STATES PATENT OFFICE

CERTIFICATE OF CORRECTION

Patent No. 3,990,462 Dated November 9, 1976

Inventor(s) Joel A. Elftmann and Robert S. Blackwood

It is certified that error appears in the above-identified patent and that said Letters Patent are hereby corrected as shown below:

In Col. 9, line 29, after "water", delete "and".

In Col. 9, line 32, delete "sources" and substitute --source--.

In Col.10, line 13, delete "including" and substitute --includes--.

Signed and Sealed this

Fourth Day of January 1977

[SEAL]

*Attest:*

RUTH C. MASON
*Attesting Officer*

C. MARSHALL DANN
*Commissioner of Patents and Trademarks*